US007321090B2

(12) United States Patent
Meng-Suen

(10) Patent No.: US 7,321,090 B2
(45) Date of Patent: Jan. 22, 2008

(54) AUTOMATIC MUSICAL INSTRUMENT

(75) Inventor: Huang Meng-Suen, Hong Kong (CN)

(73) Assignee: Mr. Christmas Incorporated, New York, NY (US)

( * ) Notice: Subject to any disclaimer, the term of this patent is extended or adjusted under 35 U.S.C. 154(b) by 246 days.

(21) Appl. No.: 11/179,621

(22) Filed: Jul. 13, 2005

(65) Prior Publication Data

US 2006/0169122 A1 Aug. 3, 2006

Related U.S. Application Data

(60) Provisional application No. 60/647,388, filed on Jan. 28, 2005.

(51) Int. Cl.
*G10F 1/06* (2006.01)

(52) U.S. Cl. ..... 84/94.1; 84/97

(58) Field of Classification Search ..... None
See application file for complete search history.

(56) References Cited

U.S. PATENT DOCUMENTS 3,395,599 A * 8/1968 Villiger ..... 84/95.1
5,698,801 A 12/1997 Meng-Suen ..... 84/101
5,870,843 A 2/1999 Hsu et al. ..... 40/411
5,949,004 A * 9/1999 Orii et al. ..... 84/95.1
5,955,687 A * 9/1999 Miyagi et al. ..... 84/97
5,973,240 A 10/1999 Isaka ..... 84/97
6,051,763 A 4/2000 Poux ..... 84/95.1
6,329,580 B1 12/2001 DeVivo ..... 84/95.1
7,250,565 B2 * 7/2007 Hermanson et al. ..... 84/94.1

* cited by examiner

*Primary Examiner*—Marlon Fletcher
(74) *Attorney, Agent, or Firm*—Fitzpatrick, Cella, Harper & Scinto

(57) ABSTRACT

An automatic musical instrument includes a tine, a rotor, an actuatable arm, and a rotatable cam. The tine emits an audible sound when vibrated. The rotor has plural picks extending radially outwardly therefrom, and the actuatable arm is disposed to displace the rotor when the actuator arm is pivoted between a normal position and an actuated position. The rotatable cam has at least one protrusion extending outwardly from a surface thereof, and is disposed to contact a pick on the rotor when the rotor is displaced by the actuatable arm. The contact of the rotating cam with the pick of the rotor further displaces the rotor, causing a pick on the rotor to vibrate the tine, emitting the audible sound.

23 Claims, 5 Drawing Sheets

AUTOMATIC MUSICAL INSTRUMENT

This application claims benefit of U.S. Provisional Patent Application No. 60/647,388, filed Jan. 28, 2005, and incorporates herein by reference that Provisional Application in its entirety.

BACKGROUND OF THE INVENTION

1. Field of the Invention

This invention generally relates to automatic musical instruments. More particularly, this invention relates to a music box using an improved method and device for playing music.

2. Description of the Related Art

While the preferred use of this invention is with a music box, and much of the following discussion of the invention is made relative to a music box, the invention is not limited to music boxes. Music boxes, player pianos, and the like, are all known types of automatic musical instruments, and features of the invention are suitable for application in numerous automatic musical instruments. Accordingly, the use of the term music box is exemplary only, and in no way limiting.

Automatic musical instruments, and in particular music boxes, are commonly known to be collectibles, heirlooms, conversation pieces, and decorations. The distinctive sound produced by music boxes is a result of reeds, or tines, being vibrated by picks. In particular, in these instruments plural tines of varying length and width, each producing a different musical note or sound, are vibrated in an arranged sequence to create a melody. Conventionally, at least three types of automatic musical instruments are known, which use three different methods to vibrate the tines.

The first of these methods utilizes a rotatable drum disposed proximate to the plurality of tines. U.S. Pat. No. 6,329,580 is an example of a drum-type music box that uses this first method. In the U.S. Pat. No. '580, a drum having prongs protruding therefrom is constantly rotated about an axis. As the drum rotates, the prongs contact the various tines of a musical tine member, causing the contacted tines to be picked and thus to vibrate. As each tine vibrates, a different musical note is produced. By providing the prongs in different arrangements on the drum, various melodies can be produced by picking the tines in the order of the notes of a melody.

While this drum-type music box has advantages in its simple construction, this first arrangement also has several drawbacks. For starters, the length of time that the drum-type music box can play music before repeating is limited by the circumference of the drum. As a result, most music boxes using this method play only a single melody, or, in some cases, only a single verse or portion of a single melody. Only by removing and replacing the drum can different songs be played. This operation, however, is not practical, as the drum is generally not easily interchangeable.

A second method of vibrating tines in an automatic musical instrument to create a melody uses a disc having protrusions formed thereon. U.S. Pat. No. 5,973,240 relates to a disc-type music box that uses this second method. As discussed in the '240, projections are formed in a pattern on a horizontally-oriented disc. As the disc rotates, the projections contact and vibrate vertically disposed tines, creating a desired melody. Alternatively, the projections may cause rotation of vertically disposed pin wheels, with each of the pin wheels corresponding to a tine of a horizontally disposed comb. When the pin wheels are rotated, a pin portion thereof contacts and vibrates the corresponding tine, creating a musical note.

Disc-type automatic musical instruments also have drawbacks. For example, like drum-type instruments, disc-type instruments also only play for a limited length of time until the music is repeated. Specifically, the length of play is proportional to the diameter of the disc. To partly compensate for this drawback, automatic musical instruments employing the disc construction are generally configured such that the disc is interchangeable, i.e., the disc may be removed and replaced with another disc, thereby allowing for change in the song to be played. However, separate, removable discs are easily misplaced and/or damaged.

A third method used to create music in automatic musical instruments is described in U.S. Pat. No. 5,698,801, which is assigned to the assignee of the present application. The automatic musical instrument utilizes a tape having a plurality of holes therethrough. The tape is fed over a plurality of discs, each having projections depending radially outwardly therefrom. During this movement of the tape, the projections on the discs are caught in the tape's holes, causing the discs to rotate. The rotation of the disc causes one of the projections on the disc to engage a corresponding tine. The projections move the tines and subsequently disengage, allowing the tines to spring back to their original position. The thus-caused vibration of the tines generates an audible sound.

Tape-type automatic musical instruments are more conducive to increased playing time to produce, for example, multiple songs, inasmuch as a longer tape can carry more projections than a drum or disc. While the tape-type instrument is an improvement over the drum-type and disc-type devices, it has its own limitations, due primarily to use of a tape and that the amount of tape required is proportional to the number of songs that can be played.

Accordingly, a further improved automatic musical instrument is desired that has the traditional musical sound of conventional automatic musical instruments, but that provides for a simplified selection of a song from a large catalog of songs, in a relatively small device.

SUMMARY OF THE INVENTION

The present invention addresses the problems of conventional automatic musical devices discussed above.

According to a first aspect of the present invention, an automatic musical instrument includes a tine, a rotor, an actuator arm, and a rotatable cam. The tine emits an audible sound when vibrated. The rotor has plural picks extending radially outwardly therefrom. The actuator arm is disposed to displace the rotor when the actuator arm is pivoted between a normal position and an actuated position. The rotatable cam has at least one protrusion extending outwardly from a surface thereof and is disposed to contact a pick on the rotor when the rotor is displaced by the actuator arm. The contact of the rotating cam with the pick of the rotor further displaces the rotor, causing a pick on the rotor to engage and thus vibrate the tine, emitting the audible sound.

According to another aspect of the present invention, an automatic musical instrument includes one or more tines, one or more rotors, one or more actuatable arms, and a rotating cam. Each of the tines creates an audible sound when vibrated. The rotors are disposed for rotation about an axis. Each of the rotors corresponds to one of the tines and each of the rotors has plural picks extending radially outwardly therefrom. Each of the arms corresponds to one of the rotors and each of the arms has a latch. The latch is disposed in the path of travel of the picks. When the arm is in a normal position, a first pick on the rotor will contact the latch. When the arm is actuated, the latch moves the first pick to effectuate a rotational displacement of the rotor. The rotating cam has one or more protrusions projecting therefrom, and when the latch displaces the rotor, a second rotor pick comes into the path of the protrusion on the rotating cam. When that protrusion contacts the second pick, the rotor is actuated such that one of the rotor's picks contacts one of the tines, thereby engaging and vibrating the corresponding tine.

According to a further aspect of the present invention, an automatic musical instrument includes a rotor, an actuatable arm, a rotating cam, and a tine. The rotor has plural picks protruding therefrom. The arm is arranged proximate to the rotor and is actuatable from a normal position to an actuated position. The arm has a latch formed at a distal end thereof, the latch being disposed in the path of travel of the picks. When the arm is in a normal position, a pick on the rotor will contact the latch, thereby stopping rotational movement of the rotor. When the arm is actuated, the latch moves the stopped pick to effectuate a rotational displacement of the rotor. The rotating cam has one or more protrusions extending radially outwardly from a surface of the rotating cam, along the axial length of the rotating cam. The rotating cam is disposed such that when the rotor is displaced rotationally as a result of the actuation of the arm, one of the protrusions may contact one of the rotor picks, imparting further rotational displacement on the rotor. The tine makes an audible sound when vibrated and is arranged proximate to the rotor. The further rotational displacement of the rotor causes one of the rotor picks to strike the tine, thereby creating an audible sound.

A better understanding of these and other aspects, features, and advantages of the invention may be had by reference to the drawings and to the accompanying description, in which preferred embodiments of the invention are illustrated and described.

BRIEF DESCRIPTION OF THE DRAWINGS

Throughout the figures, like or corresponding reference numerals are used to identify like or corresponding parts.

DETAILED DESCRIPTION OF THE PREFERRED EMBODIMENTS

Figure 1:
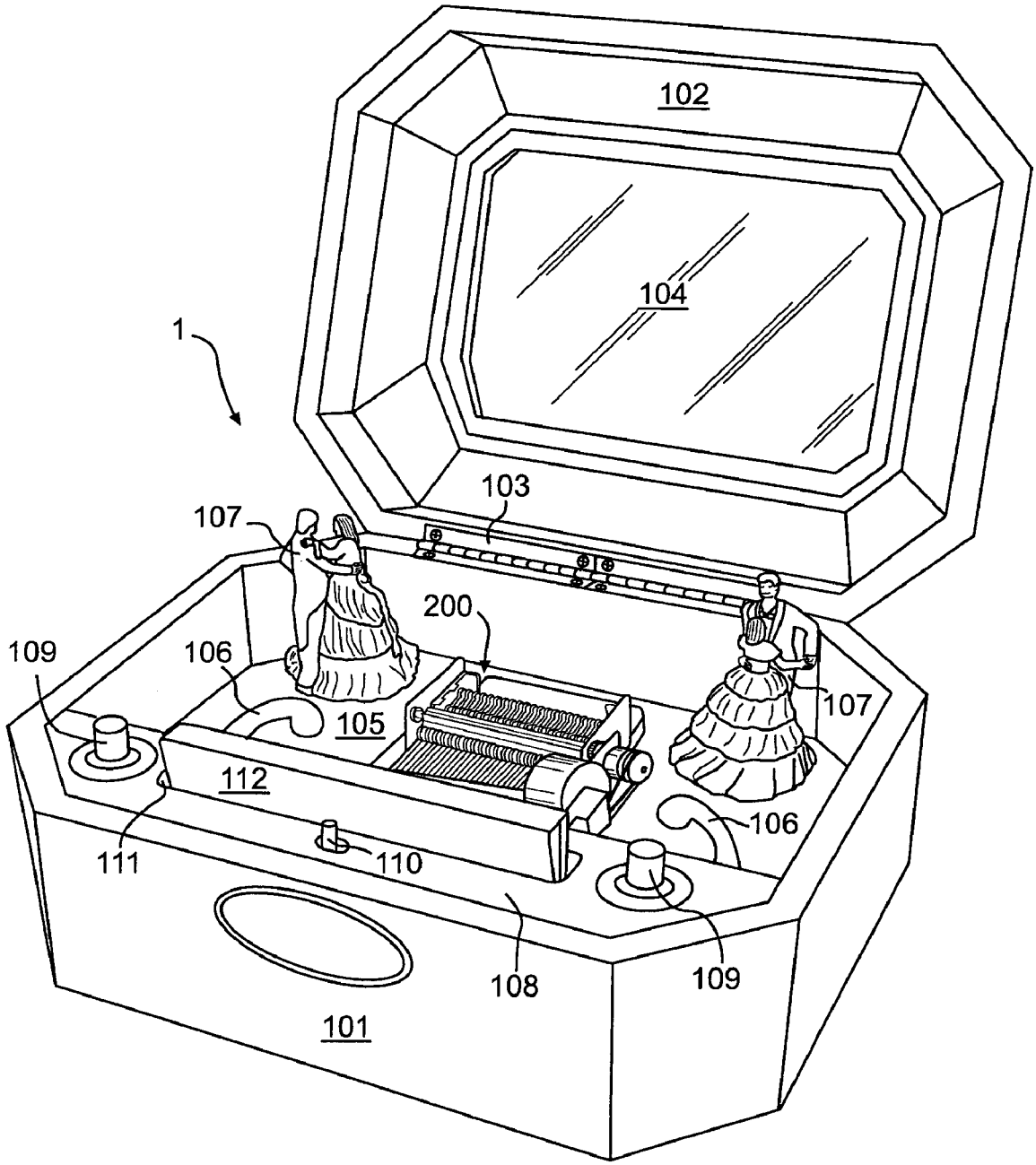
FIG. 1 is a perspective view of a music box according to an embodiment of the invention.

FIG. 1 depicts an automatic musical instrument, such as a music box 1, according to a first embodiment of the invention. As shown in that figure, the music box 1 generally includes a base 101 and a lid 102. The lid is secured to the base via a hinge 103 to facilitate opening and closing of the lid relative to the base. The lid 102 preferably includes a viewing window 104, which allows viewing of the contents of the music box 1 when the lid is closed on the base 101.

A platform 105 is arranged within the base 101 of the music box 1. Preferably, the platform is disposed above the bottom of the base 101, thus creating a cavity between the bottom of the base 101 and the platform 105. In this way, components of the music box 1 may be kept between the platform 105 and the bottom of the base 101 so that those components are out of sight.

Disposed on the platform 105 are a mechanical music module 200 (described in detail below) and various ornate articles, for example figurines 107. In addition, apertures 106 may be formed through the platform 105. The apertures 106 serve as ornate embellishments for the music box 1, and also can enhance the acoustical characteristics of the music box 1.

A shelf 108 is also preferably formed on the front of the base 101 of the music box 1. An on/off switch 110 is disposed on the shelf 108 for turning the music box 1 on and off. Additionally, two selector knobs 109 are disposed on the shelf 108, and an opening 111 is formed in the shelf 108. A playlist 112 can be stored in the opening 111. The playlist 112 contains a listing of songs that the music box 1 plays, and provides a designation, for example, an alpha-numeric designation, for each of the songs. The selector knobs 109 can be adjusted to select songs based on the designations provided in the playlist 112. For example, one of the selector knobs 109 may be adjustable between ten positions, with the positions being designated by letters A to J, and the other of the selector knobs 109 may be adjustable between ten positions, the positions being designated numerals 1 to 10. The playlist 112 then can list up to one hundred songs, each identified by an alpha-numeric indicator including a letter between A and J, and a number between 1 and 10. By turning the respective selector knobs 109 to the appropriate letter and number, the corresponding song will be played.

Figure 2:
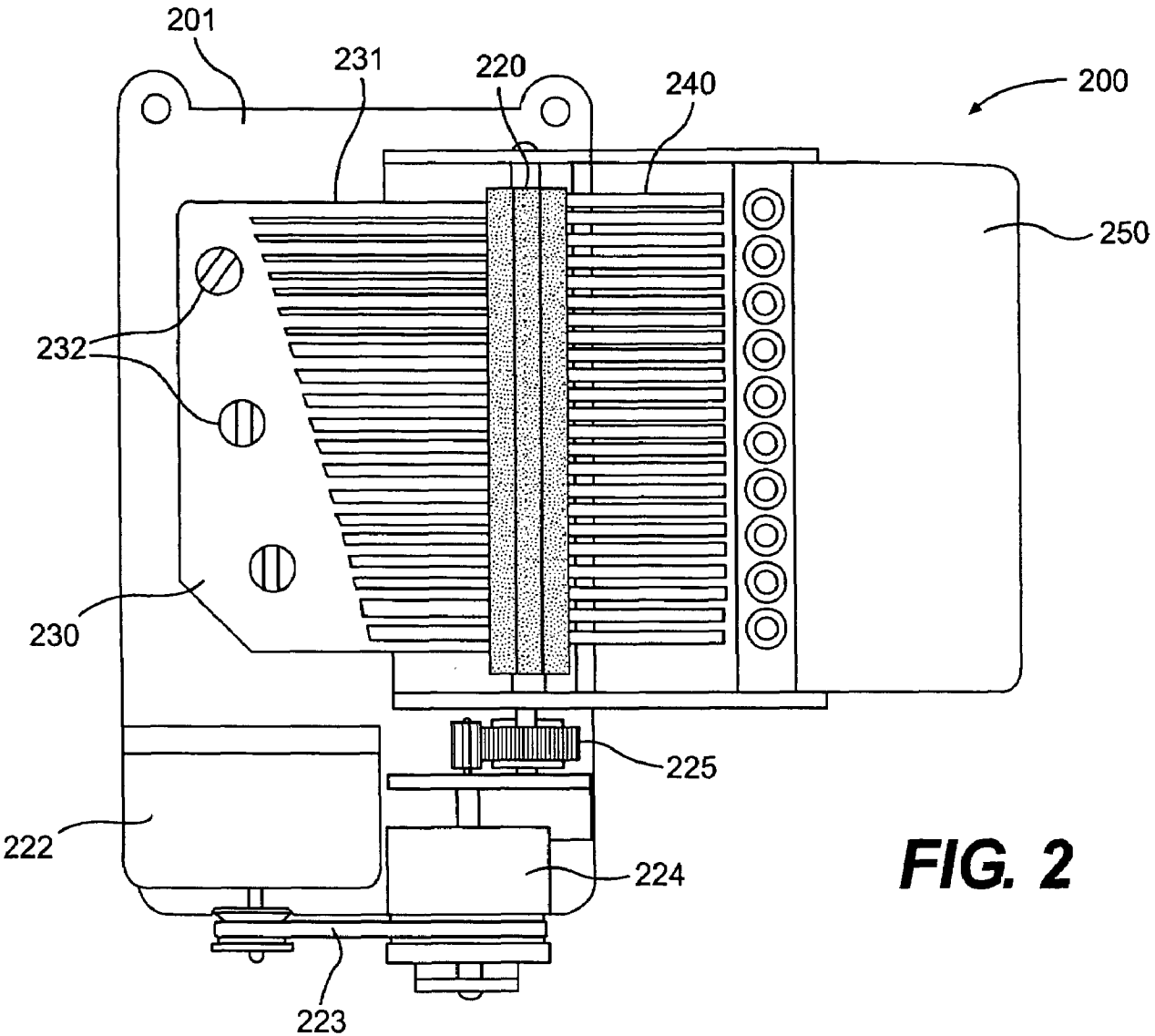
FIG. 2 is a top view of the mechanical music module 200 according to an embodiment of the invention.
Figure 3:
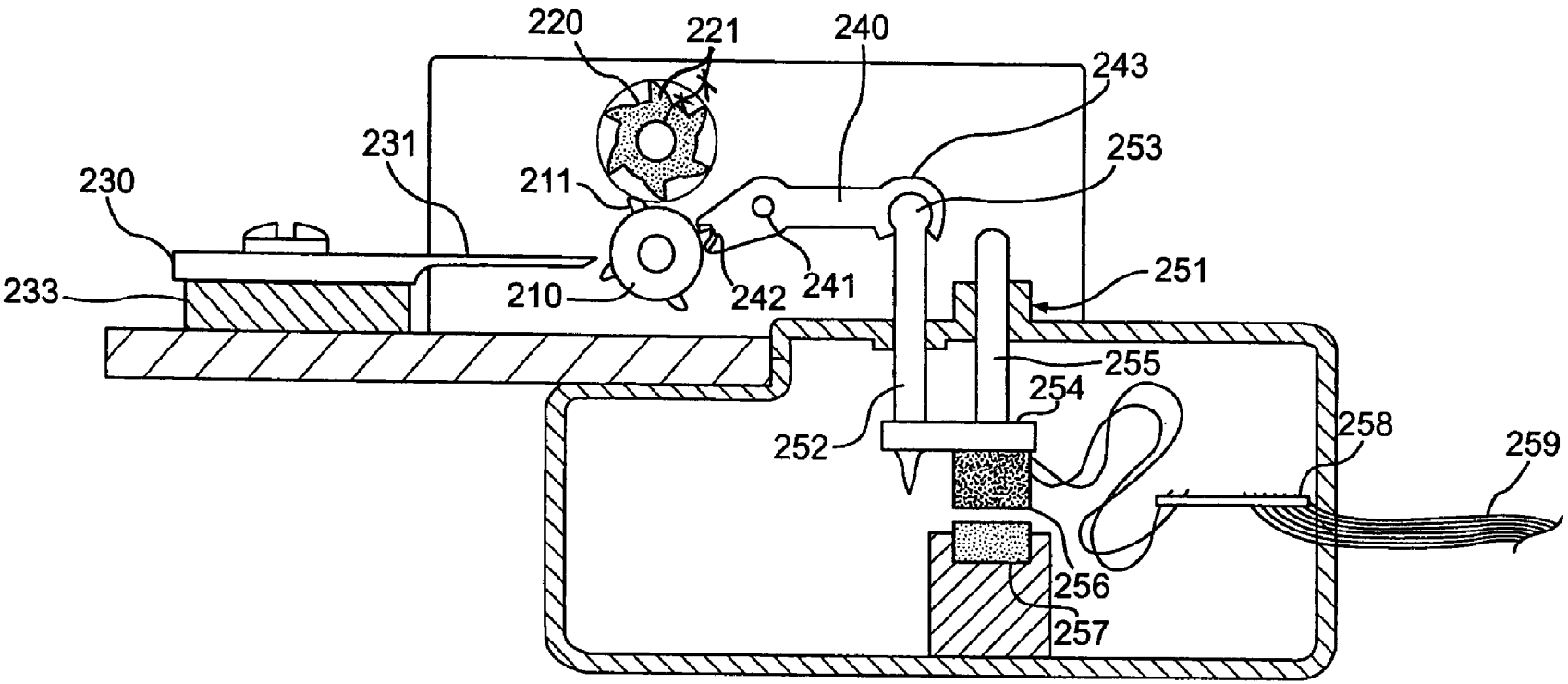
FIG. 3 is a vertical cross-sectional view taken along plane 3-3 in FIG. 2.

Also disposed on the platform 105 is the mechanical music module 200, which plays the songs selected by the selector knobs 109. As shown in FIG. 2, the mechanical music module 200 includes a base plate 201, which is used to secure the module 200 to the platform 105 of the base 101 of the music box 1. Furthermore, as shown in FIGS. 2 and 3, the mechanical music module 200 includes a plurality of rotors 210, a cam 220, a vibration plate 230, a plurality of actuatable arms 240, and a control module 250. The vibration plate 230 is formed with a plurality to tines, each of different increasing length from bottom to top as seen in FIG. 2, whereby when vibrated each tine produces a different note or sound. As will be explained, a number of rotors 210 and actuable arms 240 equal to the number of tines are provided.

As best seen in FIGS. 4A to 4D, each of the rotors 210 has a plurality of picks 211*a*-211*d* protruding radially outwardly from its periphery. As illustrated, the picks 211*a* to 211*d* are substantially saw-toothed in cross-section and are disposed at equivalent intervals about the circumference of the rotors 210. Preferably, all of the rotors 210 are disposed for rotation about the same axis, and the flat edge of the picks is a trailing edge with regard to the rotational direction of the rotor. Spacers (not shown) also may be provided between adjacent rotors 210 for reasons discussed below.

The cam 220 is generally cylindrical with protrusions 221 extending radially outwardly at regular circumferential intervals. The cam protrusions 221 extend substantially along the entire axial length of the cam 220, and, as shown in the figures, are preferably generally saw-toothed in shape, with a flat edge being a leading edge with respect to a direction of rotation of the cam 220. In addition, the cam 220 is preferably jacketed with rubber to minimize wear, and to minimize noise created when the protrusions 221 contact the picks 211 of the rotors 210 (as described in more detail below). The cam 220 is rotatable about its axis and preferably is rotated at a constant velocity by a motor 222. As shown in FIG. 2, the output of the motor 222 is transmitted to the cam 220 via a belt 223, a flywheel 224, and a gear train 225.

As noted, the vibration plate 230 includes plural tines 231. Preferably, each of the tines 231 is disposed on the vibration plate 230 so that its terminal end is fixed and its opposite, distal end is free to vibrate. The vibration plate 230 of this construction is generally comb-shaped. Furthermore, each of the tines 231 preferably has a different length and/or thickness, which causes each to emit a different sound or note when vibrated. The free end of each of the tines 231 may be tapered, to more readily facilitate displacement of the tines 231.

Each of the actuator arms 240 is mounted to pivot about a pivot shaft 241. At a distal end of each of the arms 240 is a latch 242 having a lower latch lip 242*a* and an upper latch lip 242*b*. A socket 243 is disposed at the opposite distal end of each of the actuator arms 240. The actuator arms 240 are preferably arranged in a row, that is, with the pivot shaft 241 of each of the actuator arms 240 arranged on the same axis. Indeed, all arms 240 may be mounted on the same shaft. As will be described further below, each latch 242 is preferably arranged proximate to one of the rotors 210.

The socket 243 of each of the actuator arms 240 cooperates with the control module 250, which includes plural actuator assemblies 251. In particular, the socket 243 of each of the actuator arms 240 mates with a head 253 of a pin 252, with the pin 252 being connected, for example via a connector plate 254, to an actuator 255. The actuator 255 is actuated when an electrical coil 256 is energized. A permanent magnet 257 then returns the actuator 255 to a home position when the electrical coil 256 is de-energized. An electrical terminal 258 is in communication with, and sends a signal to energize, the electrical coil 256, based on signals received from electronic controls (not shown) via, for example, a ribbon cable 259.

Having generally explained each of the components of the preferred mechanical music module 200, the preferred arrangement for these components will be described with continued reference to FIGS. 2 and 3. In the preferred arrangement, the vibration plate 230 is mounted on the base plate 201 using, for example, fasteners 232. A spacer block 233 may also be provided between the base plate 201 and the vibration plate 230, to ensure proper placement of the vibration plate 230 and the tines 231 relative to the rotor 210. The preferred vibration plate 230 depicted in FIG. 2 includes twenty tines 231 of differing length and/or thickness. Twenty rotors 210 are disposed, one corresponding to each of the tines 231, such that the picks of the rotors 210 contact the tines 231 when the rotors 210 are rotated. Spacers (not shown) can be arranged on the shaft 210*s* between the rotors 210 to ensure that the picks 211 properly align with the tines 231.

The preferred music box 1 also includes twenty actuatable arms 240, with one of the actuatable arms 240 corresponding to each of the rotors 210. Each of the actuatable arms 240 is disposed such that its latch 242 is disposed in the path of the picks 211 of the rotor 210 to which that latch 242 corresponds. As discussed above, each of the actuatable arms 240 is coupled, via its socket 243, to an actuator assembly 251.

The cam 220 also is arranged proximate to the rotors 210. In particular, the cam 220 is disposed such that the path of the protrusions 221 of the cam 220 coincides with the path of the picks of the rotors 210.

With this arrangement, the preferred method by which music is made by the mechanical music module 200 will be described in detail with reference to FIGS. 4A to 4D, in which only one rotor 210, one tine 230, and one actuator arm 240 are illustrated for clarity. As shown, the rotor 210 has a first pick 211*a*, a second pick 211*b*, a third pick 211*c*, and a fourth pick 211*d* disposed at equal intervals about its circumference. The cam 220 rotates at a constant velocity in the counterclockwise direction.

Figure 4B:
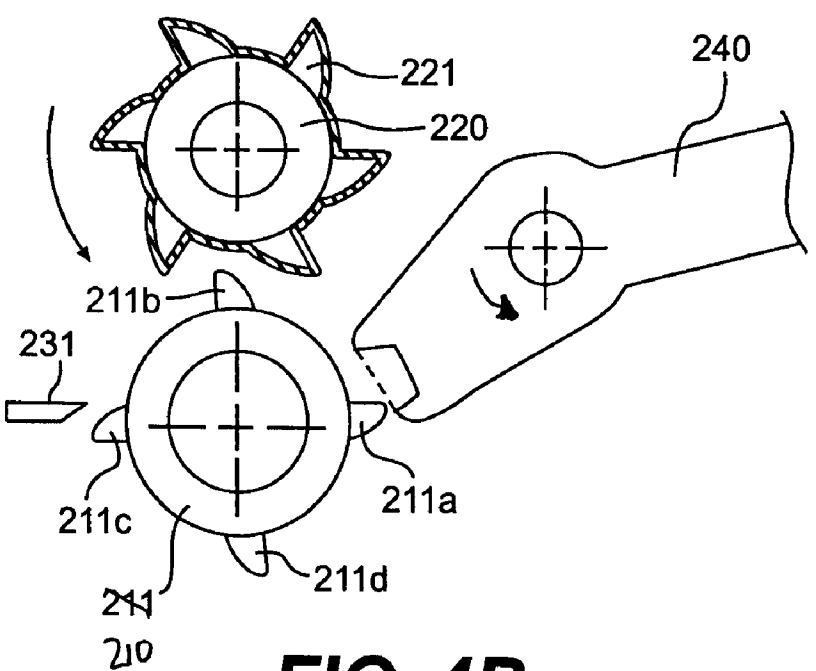
FIGS. 4A through 4D illustrate a preferred operation of a portion of the mechanical music module 200 depicted in FIGS. 2 and 3.
Figure 4A:
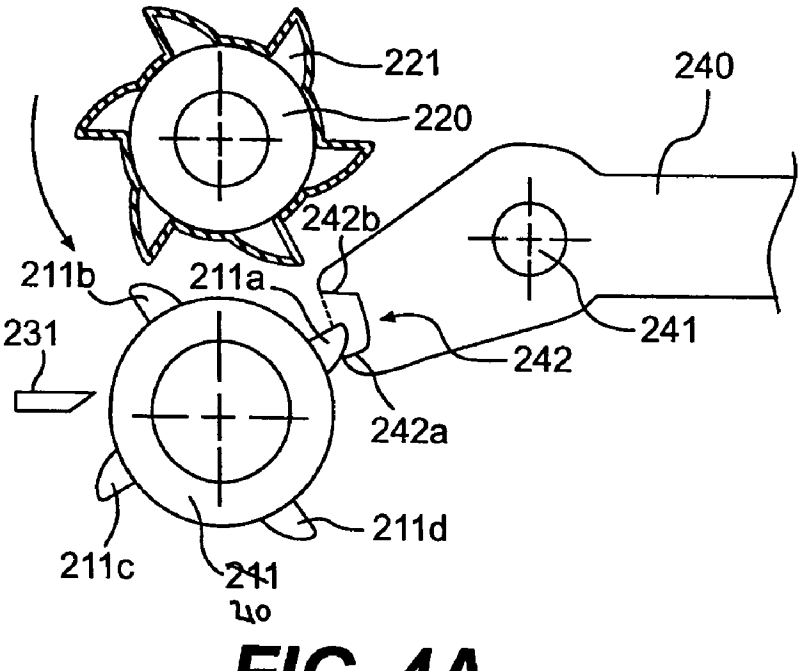

When the music box 1 is first turned on, and between notes, the mechanical music module 200 is in a normal state, illustrated in FIG. 4A. In this normal state, the rotor 210 is disposed such that the four picks 211*a*, 211*b*, 211*c*, 211*d* are outside the path of rotation of the cam 220. In other words, as the cam 220 rotates at a constant velocity, the protrusions 221 of the cam 220 do not contact any of the picks 211*a*, 211*b*, 211*c*, 211*d*. Also in the normal state, one of the four picks 211*a*, 211*b*, 211*c*, 211*d*(the first pick 211*a* in FIG. 4A) is in contact with the lower latch lip 242*a* of the actuatable arm 240, or at least within the opening between the upper and lower latch lips, so as to restrict movement.

When the electrical coil 256 (not shown in FIGS. 4A to 4D) corresponding to the actuatable arm 240 is energized, the actuatable arm 240 pivots about the pivot shaft 241 in the counterclockwise direction, as illustrated in FIG. 4B. Because of this movement, the upper latch lip 242*b* contacts and displaces the first pick 211*a* downwardly, resulting in a displacement of the rotor 211 in the clockwise direction. As should be understood, when the rotor 210 is thus displaced, all of the picks 211*a*, 211*b*, 211*c*, 211*d* are displaced in the clockwise direction. And in particular, the second pick 211*b* is moved into the path of the protrusions 221 of the rotating cam 220. The electrical coil 256 is then de-energized causing the actuatable arm 240 to return to the normal position. Of course, because the arm is rotating at high speed, this sequence of events can occur very rapidly.

Figure 4D:
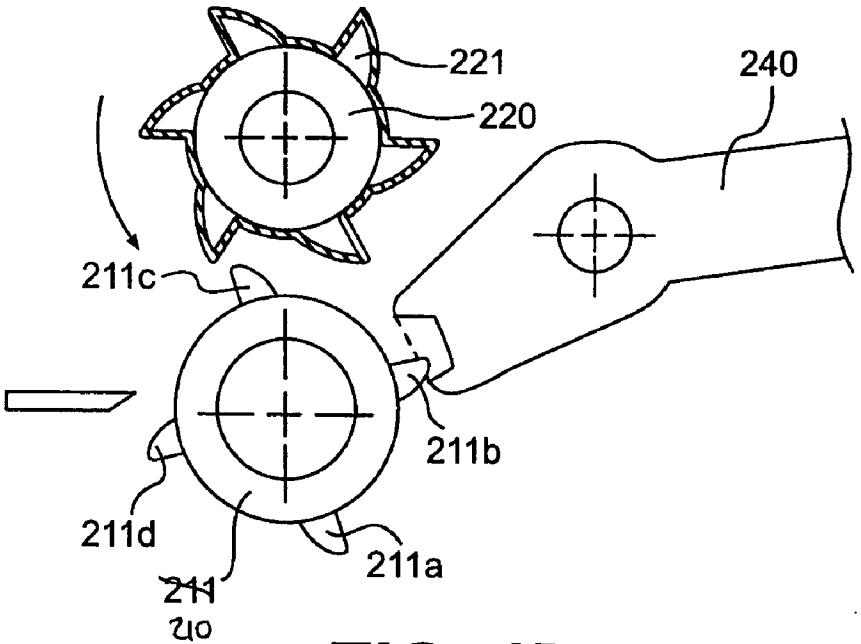
Figure 4C:
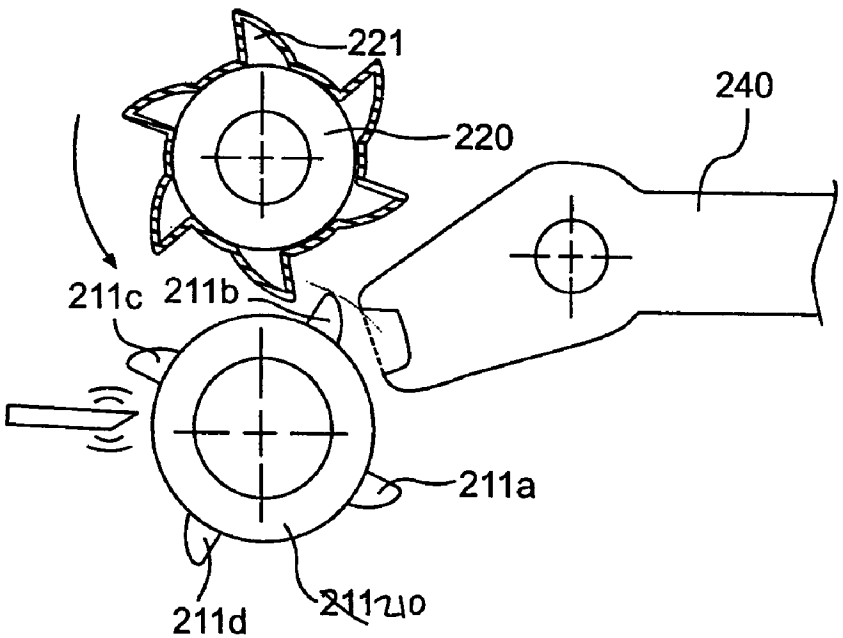

As the cam 220 continuously rotates, one of the protrusions 221 disposed thereon contacts the second pick 211*b*, as shown in FIG. 4C. As a result, the rotor 210 is caused to further rotate in the clockwise direction, and the third pick 211*c* contacts the tine 231, resulting in vibration of the tine 231, and production of a musical note. To ensure that the rotor 210 does not over-rotate when displaced by the cam 220 (which over-rotation could result in striking the tine 231 more than once, for example), the latch lower lip 242*a* is disposed to stop further rotation of the rotor 210, as shown in FIG. 4D. With the exception of the ninety degree rotation of the rotor 210, FIG. 4D is identical to FIG. 4A. Accordingly, through the process just described, a musical note is generated, and the rotor 210 and actuatable arm 240 are returned to their normal position, ready to generate another musical note.

As should be evident from the foregoing discussion, when plural corresponding actuator assemblies 251, actuatable arms 240, rotors 210, and tines 231 are provided, all operating in the manner just described, an array of combinations of musical notes can be generated. Through appropriate programming of the electronic controls, the mechanical music module 200 can be made to play any number of songs that utilize any combination of the notes from the tines 231. Specifically, the music module may comprise a programmed chip that stores a number of melodies and when actuated will drive the coils 256 in appropriate sequence to produce the desired melody selected by the controls 109, as is within the skill of the art. Moreover, through electrical connection of the selector knobs 109 to the electronic controls, a'song chosen from the playlist 112, and selected by the selector knobs 109, will be played by the mechanical music module 200.

While the present invention has been described in terms of the preferred music box 1 depicted in the Figures, several variations to that embodiment are also envisioned.

For instance, the number of tines 231 may be varied from the twenty depicted in the figures. For example, for an automatic musical instrument that plays more complex musical works having many notes, more tines 231 may be desired. Conversely, for a more simplistic automatic musical device that plays only simple melodies, a smaller number of tines 231 may be necessary.

Similarly, the number of protrusions 221 formed on the cam 220 may be varied. For example, in the embodiment discussed above, six protrusions 221 are provided on the surface of the cam 220. Accordingly, musical notes can be played at six times per rotation of the cam 220. By increasing or decreasing this number of protrusions 221, however, musical notes can be played more or less frequently during each rotation of the cam 220. In this manner, more or less complex songs, or faster or slower songs can be played. Increasing or decreasing the rotational speed of the cam 220 can also increase or decrease the pace at which songs can be played.

The number of picks formed on each of the rotors 210 also may be varied, depending upon design preference. However, it is preferred that at least two picks are provided on each of the rotors 210.

Furthermore, while the protrusions 221 on the cam 220 and the picks 211 on the rotors 210 are embodied as saw-toothed in cross-section, such is not required. In fact, the cam protrusion 221 is required only to function as discussed above, namely, to impart rotational motion on the rotors 210 to cause a pick 211 on the rotor 210 to strike a tine 231. Any protrusion that functions in this manner will suffice. Similarly, any cross-section of the picks 211 that allows the picks 211 to cause vibration of the tine 251 and that allows for the picks 211 to be contacted for imparting rotation on the rotor 210 will suffice.

In addition, while the tines 231 are shown in the figures as all being an integral part of the vibration plate 230, each of the tines 231 may be an individual piece, fastened to the vibration plate 230 using conventional means. In this manner, if a tine 231 was to break or otherwise not function properly, that specific tine could be removed and replaced. Alternatively, when all of the tines 231 are integrally formed with the vibration plate 230, if a tine 231 breaks, the entire vibration plate 230 must be replaced.

Moreover, while the cam 220 is driven in the preferred embodiment by a motor 222 via the belt 223, flywheel 224, and a gear train 225, such is not necessary. For example, the motor 222 may be directly coupled to the cam 220, to reduce the number of parts within the music box 1. Additionally, more components may be used to, for example, transfer the rotational movement of the motor to other components, like the figurines 107 arranged in the base 101 of the music box 1.

One of ordinary skill in the art will realize that these and other various modifications and variations are possible within the spirit and scope of the present invention. The invention is intended to be limited in scope only by the accompanying claims, which should be accorded the broadest interpretation so as to encompass all such modifications, equivalent structures and functions.

What is claimed is:

1. An automatic musical instrument comprising:

a tine that creates an audible sound when vibrated;

a rotor having plural picks extending radially outwardly therefrom;

an actuatable arm disposed to displace said rotor when said actuatable arm is pivoted between a normal position and an actuated position; and a rotatable cam having at least one protrusion extending outwardly from a surface thereof, wherein said rotatable cam is rotated to contact a pick on said rotor after said rotor is displaced by said actuatable arm, wherein the contact of said rotatable cam with a pick of said rotor further displaces said rotor, causing a pick on said rotor to vibrate said tine, emitting the audible sound.

2. The automatic musical instrument of claim 1, wherein said actuatable arm has a latch disposed at a distal end thereof, said latch being disposed in the path of travel of the picks of said rotor.

3. The automatic musical instrument of claim 2, wherein:

said latch is formed to contact a pick to rotate said rotor when said actuatable arm is actuated, and said latch is formed to stop further rotation of said rotor, after said rotor has been contacted by said rotatable cam.

4. The automatic musical instrument of claim 1, further comprising means for rotating said rotatable cam at a constant speed.

5. The automatic musical instrument of claim 1, further comprising an actuator that, when actuated, causes said actuatable arm to pivot from the normal position to the actuated position.

6. The automatic musical instrument of claim 5, further comprising electronic means for providing a signal to actuate said actuator.

7. The automatic musical instrument of claim 1, wherein at least a first pick, a second pick, and a third pick extend radially outwardly from said rotor, with said first pick being contacted by said actuatable arm, said second pick being contacted by said rotatable cam, and said third pick vibrating said tine.

8. An automatic musical instrument comprising:

at least one tine, said tine creating an audible sound when vibrated;

at least one rotor disposed for rotation about an axis, said rotor corresponding to one of said tines, and each of said rotors having at least one pick extending radially therefrom;

at least one actuatable arm, said arm corresponding to one of said rotors and said arm having a latch, said latch being disposed in the path of travel of said picks, wherein when said arm is in a normal position, said latch constrains movement of a first pick on said rotor, and wherein when said arm is actuated, said latch moves the first pick to effectuate a rotational displacement of said rotor; and a rotatable cam having a plurality of protrusions protruding therefrom, wherein when said latch displaces said rotor, a second rotor pick comes into the path of one of said protrusions on said rotating cam, wherein when said protrusion on said rotating cam contacts the second pick, said rotor is actuated such that said pick contacts said tine, vibrating said tine.

9. The automatic musical instrument of claim 8, further comprising:

a plurality of actuator assemblies that displace said actuatable arms from the normal position to the actuated position.

10. The automatic musical instrument of claim 8, wherein each of said tines makes a different audible sound when vibrated.

11. The automatic musical instrument of claim 8, wherein the audible sound is a musical note.

12. The automatic musical instrument of claim 8, wherein plural arms, plural rotors, and plural tines are provided, with each arm corresponding to one of said plural rotors and to one of said plural tines.

13. The automatic musical instrument of claim 8, wherein each plural tine, when struck by a pick on the corresponding rotor, produces a different musical note.

14. The automatic musical instrument of claim 8, further comprising plural actuators, one for displacing each of said actuatable arms from the normal position to the actuated position.

15. The automatic musical instrument of claim 14, further comprising electronic controls for providing signals that instruct said actuators to actuate in a predetermined order.

16. The automatic musical instrument of claim 14, wherein said actuators are biased to return automatically to a normal position after actuation.

17. The automatic musical instrument of claim 8, wherein said tines comprise a vibration plate.

18. The automatic musical instrument of claim 8, wherein the protrusions formed on said rotating cam are substantially saw-toothed in shape, with a flat leading edge, with respect to the direction of rotation of said cam, that is substantially parallel to a radius of said rotating cam and an arcuate trailing edge.

19. The automatic musical instrument of claim 14, wherein said actuatable arms are disposed for rotation about a pivot point and said actuator imparts movement on a distal end of said arm, opposite the distal end on which said latch is formed.

20. The automatic musical instrument of claim 8, wherein the axis of rotation of each of said plural rotors is the same.

21. The automatic musical instrument of claim 20, wherein the axis of rotation of said plural rotors is parallel to the axis of rotation of said rotating cam.

22. The automatic musical instrument according to claim 8, wherein the surface of said cam rotor is covered with resilient means.

23. An automatic musical instrument comprising:

a rotor having a plurality of radially extending picks;

rotor engagement means for engaging said rotor, arranged proximate to said rotor and actuatable between a first position and a second position, with said rotor engagement means preventing rotation of said rotor when in the first position and initiating rotation of said rotor when actuated to the second position;

a rotatable cam having at least one protrusion extending radially outwardly and along an axial length of said cam, wherein said rotating cam is disposed such that when said rotor is displaced rotationally by said rotor engagement means, one of said protrusions contacts a pick of said rotor, and imparts further rotational displacement to said rotor; and audible sound producing means for creating an audible sound, said audible sound means being engaged by said rotating rotor to create the audible sound.

* * * * *